US007501985B2

(12) United States Patent
Qian et al.

(10) Patent No.: US 7,501,985 B2
(45) Date of Patent: Mar. 10, 2009

(54) NANOSTRUCTURED TUNABLE ANTENNAS FOR COMMUNICATION DEVICES

(75) Inventors: Zhengfang Qian, Rolling Meadows, IL (US); Robert B. Lempkowski, Elk Grove Village, IL (US)

(73) Assignee: Motorola, Inc., Schaumburg, IL (US)

( * ) Notice: Subject to any disclaimer, the term of this patent is extended or adjusted under 35 U.S.C. 154(b) by 178 days.

(21) Appl. No.: 11/344,638

(22) Filed: Jan. 31, 2006

(65) Prior Publication Data

US 2007/0176832 A1 Aug. 2, 2007

(51) Int. Cl.
*H01Q 1/24* (2006.01)

(52) U.S. Cl. ..... 343/702; 343/700 MS

(58) Field of Classification Search ..... 343/700 MS, 343/909, 702

See application file for complete search history.

(56) References Cited

U.S. PATENT DOCUMENTS

| | | | | |
|---|---|---|---|---|
| 4,816,835 | A * | 3/1989 | Abiko et al. | 343/700 MS |
| 6,670,921 | B2 * | 12/2003 | Sievenpiper et al. | 343/700 MS |
| 6,700,550 | B2 | 3/2004 | Crowley | |
| 6,872,645 | B2 | 3/2005 | Xiangfeng et al. | |
| 6,912,195 | B2 | 6/2005 | Vook et al. | |
| 6,982,672 | B2 * | 1/2006 | Lin et al. | 343/700 MS |
| 7,038,626 | B2 * | 5/2006 | Gothard et al. | 343/702 |
| 7,176,844 | B2 * | 2/2007 | Chiang et al. | 343/815 |
| 2003/0122079 | A1 * | 7/2003 | Pobanz et al. | 250/336.1 |
| 2003/0151352 | A1 | 8/2003 | Yamaguchi | |
| 2004/0169615 | A1 | 9/2004 | Crowley | |
| 2005/0116861 | A1 | 6/2005 | Anazawa et al. | |

FOREIGN PATENT DOCUMENTS

| | | |
|---|---|---|
| JP | 2002-007992 | 1/2002 |
| JP | 2003-298338 | 10/2003 |

OTHER PUBLICATIONS

Peter J. Burke, Carbon Nanotube Devices for GHz to THz Application, Nanosensing: Material and Devices, Proceedings of SPIE vol. 5593 p. 53-61.

Peter J. Burke, Quantitative Theory of Nanowire and Naontube Antenna Performance, ArXiv:cond-mat/04048418 v1 Aug. 19, 2004.

Y. Wang and K. Kempa, Receiving and transmitting light-like radio waves: Antenna effect in arrays of aligned carbon nanotubes, Applied Science Letters, vol. 85, No. 13, Sep. 27, 2004.

Qi Zhu and Rui Wang, Research on the Possibility of Nano-Tube Antenna, Antennas and Propagation Society International Symposium, 2004. IEEE, Publication Date: Jun. 20-25, 2004, vol. 2, pp. 1927-1930.

* cited by examiner

*Primary Examiner*—HoangAnh T Le

(57) ABSTRACT

An apparatus (10, 30, 40, 50) is provided that relates to nanotubes as radiation elements for antennas and phased arrays, and more particularly to a macro-sized RF antenna for mobile devices. The antenna comprises a plurality of nanostructures (16), e.g., carbon nanotubes, forming an antenna structure on a substrate (12), and a radio frequency signal apparatus formed within the substrate (12) and coupled to the plurality of nanostructures (16). The radiation element length of a nested multiwall nanotube (161) of an exemplary embodiment may be tuned to a desirable frequency by an electromagnetic force (163).

15 Claims, 3 Drawing Sheets

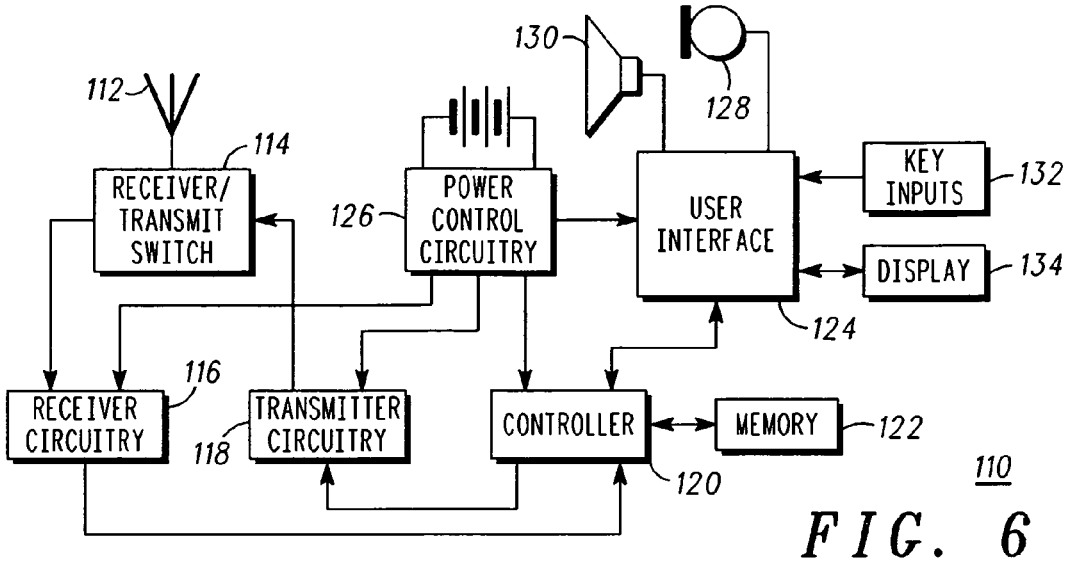
FIG. 6
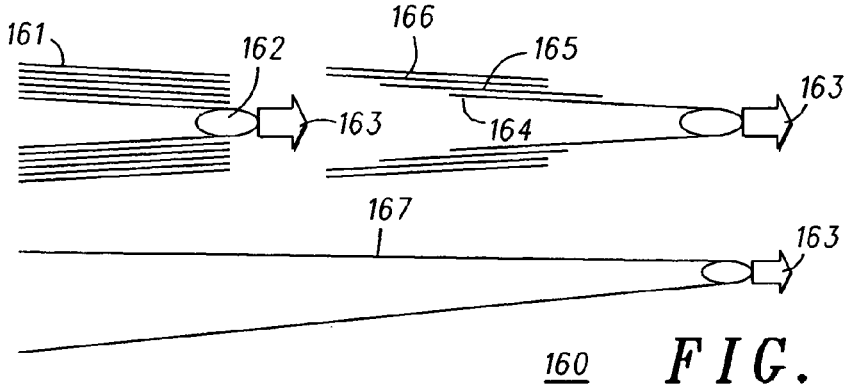
FIG. 8
FIG. 9
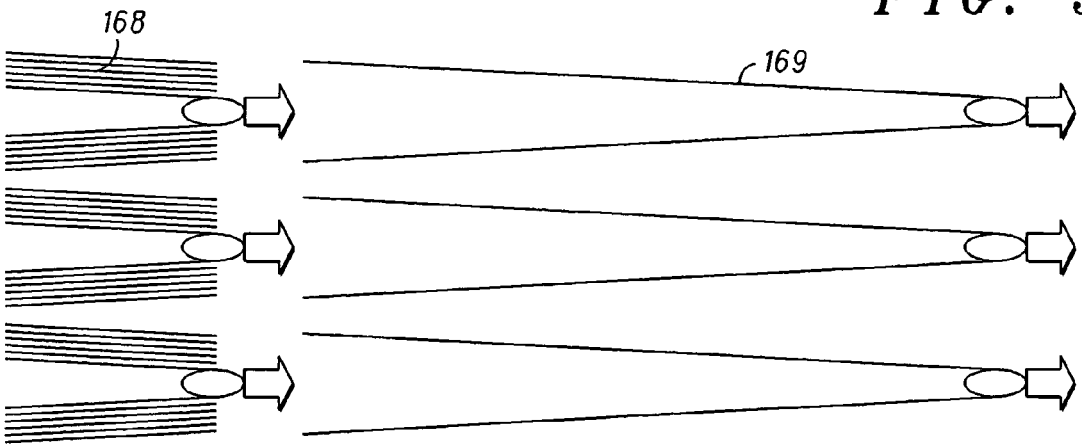

NANOSTRUCTURED TUNABLE ANTENNAS FOR COMMUNICATION DEVICES

FIELD OF THE INVENTION

The present invention generally relates to carbon nanotubes as radiation elements for antennas and phased arrays and more particularly to a macro-sized RF antenna for mobile devices.

BACKGROUND OF THE INVENTION

Global telecommunication systems, such as cell phones and two way radios, are migrating to higher frequencies and data rates due to increased consumer demand on usage and the desire for more content. Current mobile devices are challenged by the increased functionality and complexity of multi-modes, multi-bands, and multi-standards, and progressing beyond 3G with the increasing requirement of multimedia, mobile internet, connected home solutions, sensor-network, high-speed data connectivity such as Bluetooth, RFID, WLAN, WiMAX, UWB, and 4G. Limited battery power and tight design space will become bottlenecks for the high integration and development of mobile devices. The tight design space is especially challenging for RF technologies and the requisite design/fabrication of adaptive/tunable antennas and antenna arrays. Nanosized RF antennas with low power consumption will be necessary.

Known antennas ranging from macro-size to micro-size, are based on a top-down approach, and are bulky. They have difficulties in meeting performance and power-consumption requirements, particularly with increased frequency, functionality and complexity of multi-modes, multi-bands, and multi standards for seamless mobility. Size and frequency limitation such as the Terahertz gap have been reached. With the increase of high frequency for high data rate communications, skin effect becomes more of an issue and causes the loss of efficiency for these conventional solid and bulky antennas, thereby impacting power consumption.

Accordingly, it is desirable to provide a macro-sized RF antenna for mobile devices having low power consumption and wide-range frequency spectrum based on bottom-up nanotechnology. Furthermore, other desirable features and characteristics of the present invention will become apparent from the subsequent detailed description of the invention and the appended claims, taken in conjunction with the accompanying drawings and this background of the invention.

BRIEF SUMMARY OF THE INVENTION

An apparatus is provided that relates to nanotubes as radiation elements for antennas and phased arrays, and more particularly to a macro-sized RF antenna for mobile devices. The antenna comprises a plurality of nanostructures forming an antenna structure on a substrate, and a radio frequency signal apparatus formed within the substrate and coupled to the plurality of nanostructures. The radiation element length of a nested multiwall nanotube array of an exemplary embodiment may be tuned to a desirable frequency by an electromagnetic force.

BRIEF DESCRIPTION OF THE DRAWINGS

The present invention will hereinafter be described in conjunction with the following drawing figures, wherein like numerals denote like elements.

FIG. 6 is a block diagram of a portable communication device that may be used in accordance with an exemplary embodiment;

FIGS. 8 and 9 are partial cross-sectional symbolic views of a sixth exemplary embodiment that provides a method to tune the radiation element length of a nested multiwall nanotube or its array.

DETAILED DESCRIPTION OF THE INVENTION

Figure 1:
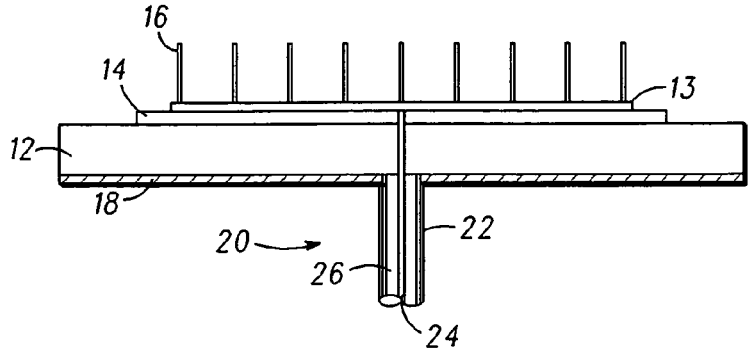
FIG. 1 is a partial cross-sectional view of a first exemplary embodiment.

The following detailed description of the invention is merely exemplary in nature and is not intended to limit the invention or the application and uses of the invention. Furthermore, there is no intention to be bound by any theory presented in the preceding background of the invention or the following detailed description of the invention.

By designing and tuning the length of nanostructures, e.g., carbon nanotubes, nanostructure antennas can perform in the broad wireless frequency spectrum from microwave such as 3G/WCDMA, to millimeter wave, and to terahertz and beyond. A method is disclosed herein for fabricating a nanostructure antenna having an adjustable length which is tunable from micrometer, to millimeter, centimeter, and decimeter, comprising a nested multiple layer of nanostructures. The length of the nanostructure antennas may be controlled by the basic length of the nanostructure and its nested layers ranging from tens to hundreds. Moreover, the method may be used to provide a tunable/adjustable nanostructure antenna. The nanostructure antenna may be embedded on, or printed in, a substrate. The low power required by the nanostructure antennas is due to the skin effect, by operating in a plasmon mode with little or no loss of efficiency.

The fabrication of nanostructure antennas is a bottom-up nanotechnology, especially suitable for high-frequency and high data rate communications. Fabrication of antennas and phased arrays can be precise and controlled at the atomic level. Therefore, nanostructure antennas intrinsically perform from gigahertz to terahertz and beyond without size limitations. These antennas can operate in a plasmon mode with ultra-low power consumption while providing device miniaturization. Moreover, these nanostructure antennas and arrays are mechanically robust for reliability, have electrically superior conduction, are flexible for form factors, and tunable for performance optimization. Due to the fact that single wall nanotubes are resistive, and a nanotube array with required tube numbers, diameters, lengths, and patterns can be fabricated at the atomic level from the bottom-up nanotechnology for impedance matching and performance tuning. Fabrication of antennas and phased arrays of different frequencies on one substrate or multiple substrates may be accomplished for multiple bands/modes.

Nanostructures such as nanotubes, nanowires, and their arrays show promise for the development of macro-sized antennas and antenna arrays. Preparation of these nanostructures by chemical vapor deposition (CVD) has shown a clear advantage over other approaches. In addition, the CVD approach allows for the growth of high quality nanotubes by controlling the size, location, and pattern of catalytic nanoparticles. The growth direction of the nanotubes can be furthermore controlled by plasma-enhanced CVD processing. For example, the diameters of multi-walled nanotubes are typically proportionally related to the sizes of the catalytic nanoparticles used in the CVD process.

Carbon is one of the most important known elements and can be combined with oxygen, hydrogen, nitrogen and the like. Carbon has four known unique crystalline structures including diamond, graphite, fullerene and carbon nanotubes. In particular, carbon nanotubes typically refer to a helical tubular structure grown with a single wall or multi-wall, and commonly referred to as single-walled nanotubes (SWNTs), or multi-walled nanotubes (MWNTs), respectively. These types of nanostructures are obtained by rolling a sheet formed of a plurality of hexagons. The sheet is formed by combining each carbon atom thereof with three neighboring carbon atoms to form a helical tube. Single wall carbon nanotubes typically have a diameter in the order of a fraction of a nanometer to a few nanometers. Multiwall carbon nanotubes typically have an outer diameter in the order of a few nanometers to several hundreds of nanometers, depending on inner diameters and numbers of layers. Each layer is still a single wall of the nanotube. The multi-wall carbon nanotube with large diameter is generally longer. Carbon nanotubes can function as either a conductor, like metal, or a semiconductor, according to the rolled shape (chirality) and the diameter of the helical tubes. With metallic-like nanotubes, a carbon-based structure can conduct a current in one direction at room temperature with essentially ballistic conductance so that metallic-like nanotubes can be used as ideal interconnects, RF signal receptors, and radiation elements. It is also found that the band gap of a carbon nanotube is inversely proportional to the tube diameter. Therefore, it is necessary to keep the tube diameter small for semiconducting single wall nanotubes. Instead, a multiwall carbon nanotube with large diameter, in general, is metallic in nature. Such super metallic property is desirable to the design of nanotube antennas and phased arrays.

Both carbon nanotubes and inorganic nanowires have been demonstrated as field effect transistors (FETs) and other basic components in nanoelectronics such as p-n junctions, bipolar junction transistors, inverters, etc. The motivation behind the development of such nanoscale components is that "bottom-up" approach to nanoelectronics has the potential to go beyond the limits of the traditional "top-down" manufacturing techniques. However, carbon nanotubes, and in particular multiwall nanotubes, have not previously been explored as radiation elements, and their array structures have not been explored for antenna applications. As used herein, a "carbon nanotube" is any elongated carbon structure.

Referring to FIG. 1, illustrated in simplified cross-sectional views, a first exemplary embodiment of the structure 10 comprises a nanostructure substrate 14 integrated with (PWB) substrate 12. The nanostructure substrate 14 may comprise most any substrate know in the semiconductor industry, e.g., glass, silicon, gallium arsenide, indium phosphide, silicon carbide, gallium nitride, and flexible materials such as Mylar® and Kapton®, but more preferably for high frequency applications comprises a material having high resistivity such as quartz or sapphire. The PWB substrate 12 preferably comprises fiberglass reinforced resin types (such as FR-4), low temperature co-fired ceramic (LTCC), liquid crystal polymer (LCP), and Teflon impregnated mesh types. A conductive layer 13, e.g., a catalyst, is formed on the nanostructure substrate 14. Examples of suitable catalytic material (which may comprise catalytic nanoparticles) for the catalytic layer 13 for nanostructure growth include titanium, vanadium, chromium, manganese, copper, zirconium, niobium, molybdenum, silver, hafnium, tantalum, tungsten, rhenium, gold, ruthenium, rhodium, palladium, osmium, iridium, platinum, nickel, iron, cobalt, or a combination thereof. More particularly for carbon nanotube growth, examples include nickel, iron, and cobalt, or combinations thereof. And for silicon nanowire growth, examples include gold or silver.

A ground plane 18 is formed on the side of the PWB substrate opposed to the nanostructure substrate 14 by lamination, sputtering, or plating. A coaxial connector 20 is formed wherein the shield 22 is connected to the ground plane 18 and the inner conductor 24 is coupled to the conductive layer 13. The coaxial connector 20 and shield 22 may comprise any conductive material, but preferably would comprise gold, silver, titanium, aluminum, chromium, or copper. An insulative material 26 is formed between the coaxial connector 20 and shield 22. Although a coaxial connector 20 is shown, the transmission may be accomplished by any type of transmission line.

Nanostructures 16, such as belts, rods, tubes and wires, and more preferably carbon nanotubes, are grown on the nanostructure substrate 14 in a manner as described above. For example, the nanostructures 16 may be grown by plasma enhanced chemical vapor deposition, high frequency chemical vapor deposition, or thermal vapor deposition. The nanostructures 16 preferably will be of a determined length for the frequency of the particular application. For microwave transmissions, the length of the nanostructures 16 would be in the range of 0.5 centimeters to 2.0 centimeters. For millimeter wave transmissions, the length of the nanostructures 16 would be in the range of 0.05 millimeter to 0.5 centimeter. For terahertz and beyond terahertz transmissions, the length of the nanostructures 16 would be in the range of 1.0 nanometer to 0.05 millimeter.

Though the nanostructures 16 may be grown by any method known in the industry, one preferred way of growing carbon nanotubes is as follows. A chemical vapor deposition (CVD) is performed by exposing the structures 13 and 14 to hydrogen ($H_2$) and a carbon containing gas, for example methane ($CH_4$), between 450° C. and 1,000° C., but preferably between 550° C. and 850° C. CVD is the preferred method of growth because the variables such as temperature, gas input, and catalyst may be controlled. Carbon nanotubes 16 are thereby grown from the substrate 14 forming a single nanostructures or a network (i.e., mesh) of connected carbon nanotubes 16. Although only a few carbon nanotubes 16 are shown, those skilled in the art understand that a large number of carbon nanotubes 16 could be grown. Furthermore, the carbon nanotubes are illustrated as growing in a vertical direction with plasma enhanced processing. It should be understood that they may lay in a horizontal position to form the network. The nanostructures 16 may be grown in any manner known to those skilled in the art, and are grown to a desired length and diameter. Furthermore, the carbon nanotubes 16 may be coupled by vias or air-bridges, for example, to other points within an integrated circuit residing on the substrate.

In operation, a signal is applied to the inner conductor 24 and the signal is transferred to the nanostructures 16 by the conductive layer 13.

Figure 2:
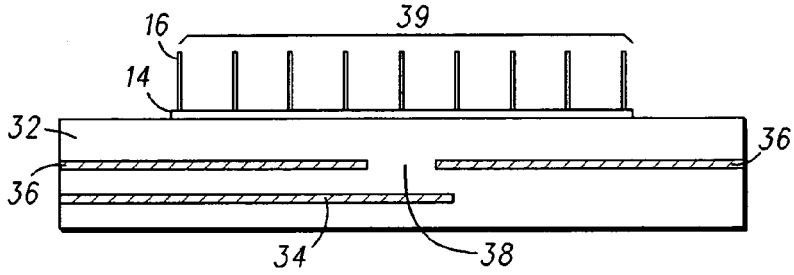
FIG. 2 is a partial cross-sectional view of a second exemplary embodiment.

Referring to FIG. 2, a second exemplary embodiment comprises a structure 30 having the nanostructure substrate 14 and nanostructures 16 formed on a substrate 32 having a transmission line 34 and ground plane 36 formed therein. The ground plane 36 defines a slot, or aperture, 38. The substrate 12 may comprise layers formed at different times in the process. For example, the transmission line 34 may be formed after a first layer of the substrate 12 is formed and before the layer of the substrate 12 is formed above the transmission line. The substrate 12 layers may or may not comprise the same dielectric material.

In operation, a signal is applied to transmission line 34, which causes the slot 38 to resonate, and the signal is passed to the nanostructures 16 electromagnetically.

Figure 3:
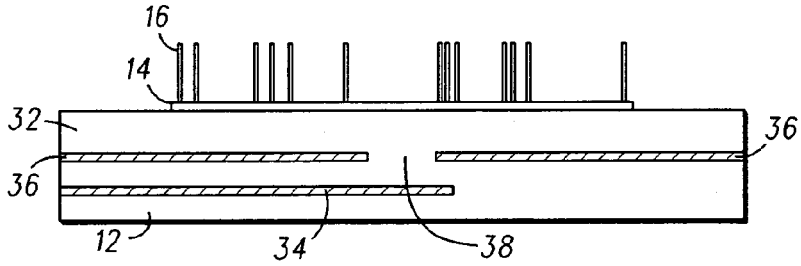
FIG. 3 is a partial cross-sectional view of a third exemplary embodiment.

A third exemplary embodiment, that is similar to the second exemplary embodiment of FIG. 2, is shown in FIG. 3. The difference is that the nanostructures 16 are randomly placed on the nanostructure substrate 14.

Figure 4:
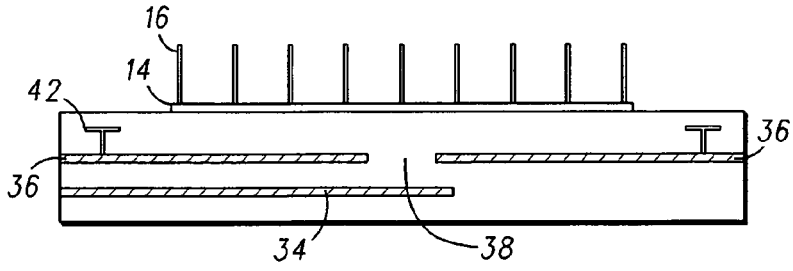
FIG. 4 is a partial cross-sectional view of a fourth exemplary embodiment.

Referring to FIG. 4, a fourth exemplary embodiment comprises the structure 40 having a fixed or micro-electro-mechanical system (MEMS)-tuned electromagnetic bandgap structure 42 formed on the layer 36. The MEMS-tuned EBG (electromagnetic bandgap) structure 42 is positioned between adjacent structures 40 (array elements), providing isolation therebetween. Conventionally, antenna element 39 (nanostructures 16) would be positioned approximately a half wavelength apart. Fixed or MEMS-tuned EBG structure 42 allows the structures 40 to be positioned much closer together, e.g., within less than a quarter wavelength apart. By changing the size and coupling of the EBG capacitor elements individually and relative to each other, tuning of the frequency-selective surface can be performed. This tuning can be performed by using a MEMS switch for selecting an annular ring around the EBG element, using a MEMS varactor to switch and tune additional capacitance to the ring, or use a common packaged varactor for such tuning.

Figure 5:
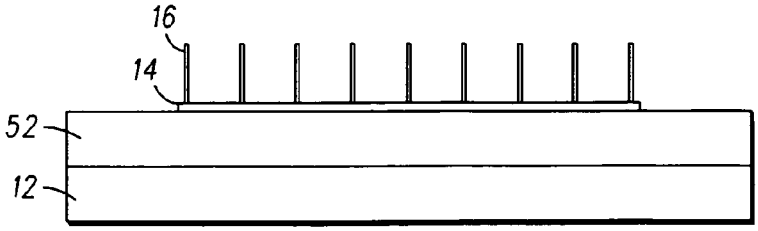
FIG. 5 is a partial cross-sectional view of a fifth exemplary embodiment.

Referring to FIG. 5, a fifth exemplary embodiment comprises the structure 50 having a dielectric waveguide 52 formed on the substrate 12. The dielectric waveguide 52 comprises a dielectric material having a different coefficient of permittivity than the substrate 12. As a signal passes along the waveguide 52, it is transferred to the nanosturctures 16.

Referring to FIG. 6, a block diagram of a portable communication device 110 such as a cellular phone, in accordance with the preferred embodiment of the present invention is depicted. The portable electronic device 110 includes an antenna 112 for receiving and transmitting radio frequency (RF) signals, which may comprise any embodiments within the present invention, e.g., structures 10, 30, 40, and 50. A receive/transmit switch 114 selectively couples the antenna 112 to receiver circuitry 116 and transmitter circuitry 118 in a manner familiar to those skilled in the art. The receiver circuitry 116 demodulates and decodes the RF signals to derive information therefrom and is coupled to a controller 120 for providing the decoded information thereto for utilization thereby in accordance with the function(s) of the portable communication device 110. The controller 120 also provides information to the transmitter circuitry 118 for encoding and modulating information into RF signals for transmission from the antenna 112. As is well-known in the art, the controller 120 is typically coupled to a memory device 122 and a user interface 124 to perform the functions of the portable electronic device 110. Power control circuitry 126 is coupled to the components of the portable communication device 110, such as the controller 120, the receiver circuitry 116, the transmitter circuitry 118 and/or the user interface 124, to provide appropriate operational voltage and current to those components. The user interface 124 includes a microphone 128, a speaker 130 and one or more key inputs 132, including a keypad. The user interface 124 may also include a display 134 which could include touch screen inputs.

Figure 7:
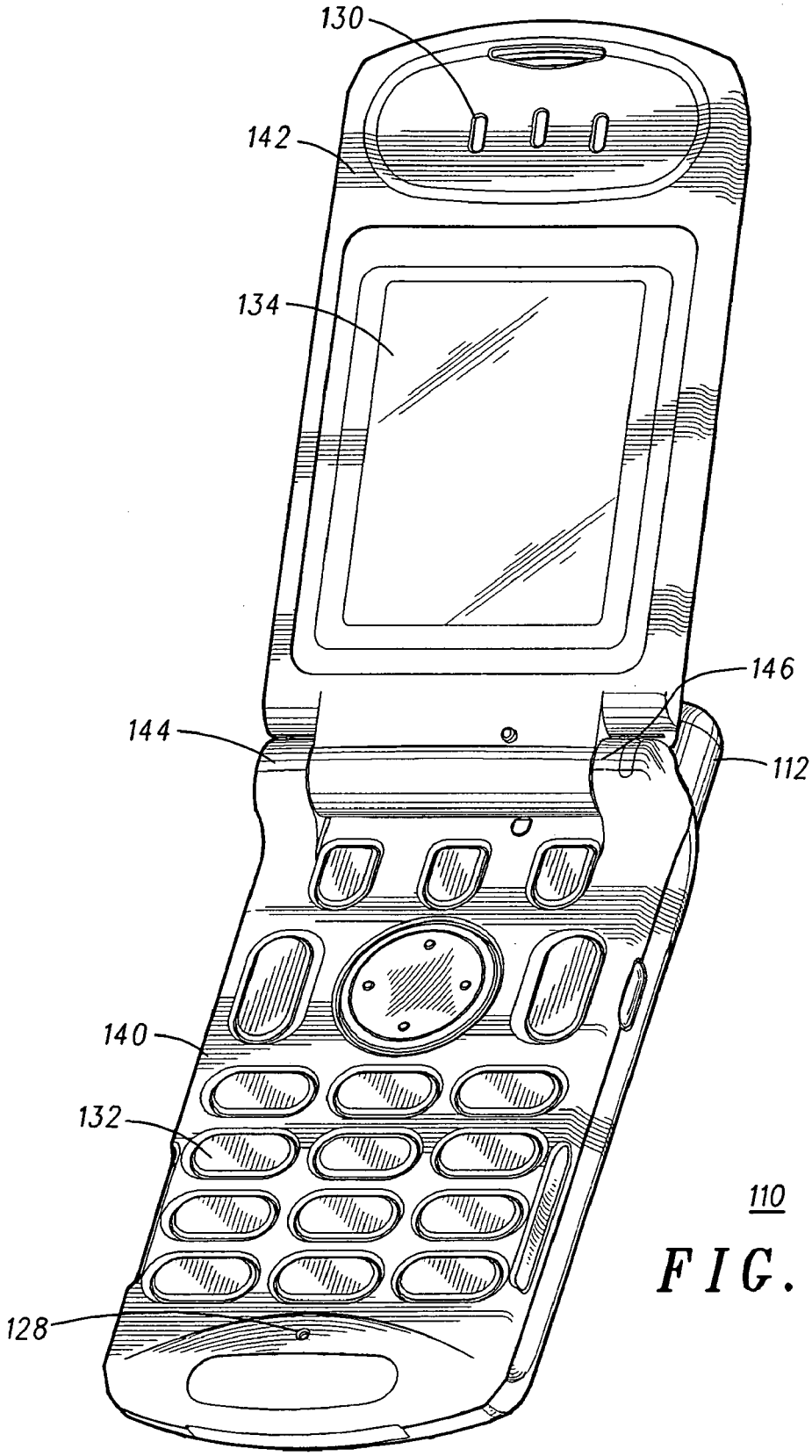
FIG. 7 is a diagram of portable communication device that may be used in accordance with an exemplary embodiment.

Referring to FIG. 7, the portable communication device 110 in accordance with the preferred embodiment of the present invention is depicted. The portable communication device 110 includes a housing which has a base portion 140 for enclosing base portion circuitry and an upper clamshell portion 142 for enclosing upper clamshell portion circuitry. The base portion 140 has the microphone 128 mounted therein and a plurality of keys 132 mounted thereon. The upper clamshell portion 142 has the speaker 130 and the display 134 mounted thereon. A plurality of hinges, such as hinge knuckles 144 and 146, rotatably couple the base portion 140 of the housing to the upper clamshell portion 142. The antenna 112 can be mounted either external or internal or inside the housing with a proper grounding in the portable device 110.

Referring to FIGS. 8 and 9, a method 160 is provided to tune the radiation element length from a nested multiwall nanotube 161. The nested multi-layers 161 of a multiwall nanotube 16 on substrate 14 is presented with a catalytic nanoparticle 162, for instance, comprising nickel or iron, on the top of the multiwall nanotube. The tip of the multiwall nanotube can be opened to reveal the nanoparticle 162 by means of chemical, electrical, or mechanical methods if the particle is covered. An electromagnetic force 163 can be applied through a static electromagnetic field by a magnet (not shown). The inner tube layer 164 can be pulled out under the force 163. And the second inner layer 165 can be forced to move together with the first inner layer 164 due to interlayer friction, elastic force interaction, and/or van der Walls interaction. A slight taper or small angle induced by the catalytic nanocrystal surface is used to enforce the movement of inner layers. An isolated defect between two layers is also useful for the pulling action of inter layers, although it is not desirable. The layers 164 and 166 are subjected to an extra elastic force from layer 165 due to a nanoscale displacement. Therefore, layers 164, 165, and 166 are bonded together by the interlayer forces. Based on the described mechanism, a radiation element 167 can be adjusted to the length required by the antenna frequency. This length can be further controlled by the layers and length of each layer. Moreover, an array of nested multiwall nanotubes 168 (FIG. 9) on the substrate 14 can be tuned by the method 160 to requisite length 169 for forming the nanostructure 16.

While at least one exemplary embodiment has been presented in the foregoing detailed description of the invention, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment of the invention, it being understood that various changes may be made in the function and arrangement of elements described in an exemplary embodiment without departing from the scope of the invention as set forth in the appended claims.

The invention claimed is:

1. An antenna comprising:

a substrate comprising a material;

a plurality of nanostructures forming an antenna structure on the substrate, the nanostructures selected from one of the group consisting of nanotubes, nanowires, nanorods, and nanobelts; and a radio frequency signal apparatus comprising a dielectric waveguide formed within the substrate, a coupling between the radio frequency signal apparatus and the plurality of nanostructures consisting of electromagnetic waves-through the material of the substrate.

2. The antenna of claim 1 wherein the nanostructures are randomly positioned on the substrate.

3. The antenna of claim 1 wherein the nanostructures are uniformly positioned on the substrate.

4. The portable communication device of claim 1 wherein the antenna structure comprises a length capable of receiving a waveform having a wavelength of between 0.5 centimeter to 2.0 centimeters.

5. The portable communication device of claim 1 wherein the antenna structure comprises a length capable of receiving a waveform having a wavelength of between 0.5 millimeter to 0.5 centimeter.

6. The portable communication device of claim 1 wherein the antenna structure comprises a length capable of receiving a waveform having a wavelength of between 1.0 nanometer to 0.5 millimeters.

7. The antenna of claim 1 wherein the plurality of nanostructures comprise a phased array.

8. A portable communication device comprising:

a user interface;

receiver circuitry;

a controller coupled between the user interface and the receiver circuitry; and an antenna coupled to the receiver circuitry, the antenna comprising:

a substrate;

a plurality of nanostructures formed as an antenna structure on the substrate, the nanostructures selected from one of the group consisting of nanotubes, nanowires, nanorods, and nanobelts; and electronic apparatus comprising a dielectric waveguide formed within the substrate and coupled to the plurality of nanostructures consisting of electromagnetic waves through the material of the substrate.

9. The antenna of claim 8 wherein the nanostructures are randomly positioned on the substrate.

10. The antenna of claim 8 wherein the nanostructures are uniformly positioned on the substrate.

11. The portable communication device of claim 8 wherein the antenna structure comprises a length capable of receiving a waveform having a wavelength of between 0.5 centimeter to 2.0 centimeters.

12. The portable communication device of claim 8 wherein the antenna structure comprises a length capable of receiving a waveform having a wavelength of between 0.5 millimeter to 0.5 centimeter.

13. The portable communication device of claim 8 wherein the antenna structure comprises a length capable of receiving a waveform having a wavelength of between 1.0 nanometer to 0.5 millimeter.

14. A method of tuning an antenna having a substrate, a plurality of nested multiwall nanotubes forming an antenna structure on the substrate and having at least one inner wall, and a radio frequency signal apparatus formed within the substrate, a coupling between the radio frequency signal apparatus and the plurality of nested multiwall nanostructures consisting of electromagnetic waves through the substrate, the method comprising:

applying an electromagnetic force to the nested multiwall nanostructures; and displacing the at least one inner wall.

15. The method of claim 14 wherein the radio frequency signal apparatus comprises one of a ground plane, a transmission line, one or more MEMS-tuned electromagnetic bandgap structures, a dielectric waveguide.

* * * * *